US009254434B2

(12) United States Patent
Chang

(10) Patent No.: US 9,254,434 B2
(45) Date of Patent: Feb. 9, 2016

(54) FIXATION SEAT FOR SKI SHOE

(71) Applicant: TZY SHENQ ENTERPRISE CO., LTD., Taichung (TW)

(72) Inventor: Li-Chen Chang, Taichung (TW)

(73) Assignee: TZY SHENQ ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 14/710,219

(22) Filed: May 12, 2015

(65) Prior Publication Data

US 2015/0367226 A1 Dec. 24, 2015

Related U.S. Application Data

(63) Continuation-in-part of application No. 14/312,172, filed on Jun. 23, 2014, now Pat. No. 9,114,309.

(51) Int. Cl.

| | |
|---|---|
| ***A63C 10/24*** | (2012.01) |
| ***A63C 10/02*** | (2012.01) |
| ***A63C 10/18*** | (2012.01) |

(52) U.S. Cl.

CPC ..... *A63C 10/24* (2013.01); *A63C 10/02* (2013.01); *A63C 10/18* (2013.01)

(58) Field of Classification Search

CPC ..... A63C 10/04; A63C 10/06; A63C 10/10; A63C 10/18; A63C 10/24

See application file for complete search history.

(56) References Cited

U.S. PATENT DOCUMENTS

| | | | | |
|---|---|---|---|---|
| 5,556,123 | A | 9/1996 | Fournier | |
| 5,660,410 | A | 8/1997 | Alden | |
| 5,853,188 | A | 12/1998 | Alden | |
| 6,099,018 | A | 8/2000 | Maravetz et al. | |
| 6,155,578 | A * | 12/2000 | Patterson | A63C 10/18 280/14.24 |
| 6,199,893 | B1 | 3/2001 | Fumagalli | |
| 6,206,403 | B1 * | 3/2001 | Black | A63C 10/06 280/14.22 |
| 6,390,492 | B1 | 5/2002 | Bumgarner et al. | |
| 6,443,465 | B1 | 9/2002 | Maravetz et al. | |
| 6,543,793 | B1 * | 4/2003 | Reuss | A43B 5/04 280/11.36 |
| 6,575,489 | B1 | 6/2003 | White | |
| 6,631,919 | B1 * | 10/2003 | West | A43B 5/0401 280/11.36 |
| 6,729,641 | B2 | 5/2004 | Okajima et al. | |
| 6,733,031 | B2 | 5/2004 | Okajima et al. | |
| 6,783,146 | B1 | 8/2004 | Going | |
| 6,889,997 | B2 | 5/2005 | Okajima | |
| 7,073,809 | B2 | 7/2006 | Holzer | |
| 7,147,233 | B2 * | 12/2006 | Edmond | A63C 10/04 280/14.22 |
| 7,159,892 | B2 | 1/2007 | Draper et al. | |

(Continued)

FOREIGN PATENT DOCUMENTS

| | | |
|---|---|---|
| TW | 257991 | 9/1995 |
| TW | 298090 | 2/1997 |

(Continued)

*Primary Examiner* — Brodie Follman

(74) *Attorney, Agent, or Firm* — Muncy, Geissler, Olds & Lowe P.C.

(57) ABSTRACT

A fixation seat for ski shoe includes a seat, a connecting structure, a left support element, a right support element, and an ankle protecting board. The connecting structure is disposed on the seat for connecting with a ski board. The left and the right support elements extend upward and obliquely from two sides of the seat toward the rear side of the seat. At the rear side of the seat, the left support element is distant from the right support element a predetermined distance. The ankle protecting board is connected to tops of the left and the right support elements.

13 Claims, 4 Drawing Sheets

(56) References Cited

U.S. PATENT DOCUMENTS

| | | | | |
|---|---|---|---|---|
| 7,232,147 | B2 | 6/2007 | Couderc | |
| 7,316,412 | B2 * | 1/2008 | Couderc | A63C 10/04 280/11.3 |
| 7,410,177 | B2 | 8/2008 | Giffin et al. | |
| 7,503,579 | B2 | 3/2009 | Couderc | |
| 7,963,546 | B2 | 6/2011 | Veyrat-Charvillon | |
| 7,992,888 | B2 * | 8/2011 | Steere | A63C 10/24 280/14.22 |
| 8,016,315 | B2 | 9/2011 | Neiley et al. | |
| 8,128,117 | B2 * | 3/2012 | Neiley | A63C 10/18 280/14.21 |
| 8,191,917 | B2 | 6/2012 | Wang et al. | |
| 8,226,108 | B2 * | 7/2012 | Pontano | A63C 10/06 280/618 |
| 8,540,271 | B2 | 9/2013 | Chou et al. | |
| 9,114,309 | B1 * | 8/2015 | Chang | A63C 10/24 |
| 2001/0010418 | A1 | 8/2001 | Gonthier | |
| 2002/0008366 | A1 | 1/2002 | Rittmeyer | |
| 2002/0070530 | A1 | 6/2002 | Gouzes et al. | |
| 2002/0089151 | A1 | 7/2002 | Carrasca | |
| 2002/0101044 | A1 | 8/2002 | Gonthier | |
| 2002/0153703 | A1 | 10/2002 | Okajima et al. | |
| 2003/0127832 | A1 | 7/2003 | Couderc et al. | |
| 2003/0146600 | A1 | 8/2003 | Holzer | |
| 2003/0193151 | A1 | 10/2003 | Reuss et al. | |
| 2004/0145128 | A1 | 7/2004 | Couderc | |
| 2004/0150192 | A1 | 8/2004 | Okajima | |
| 2004/0150193 | A1 | 8/2004 | Uchie et al. | |
| 2005/0046150 | A1 | 3/2005 | Couderc | |
| 2005/0057009 | A1 | 3/2005 | Couderc | |
| 2005/0167933 | A1 | 8/2005 | Couderc | |
| 2005/0280247 | A1 | 12/2005 | Couderc | |
| 2005/0285372 | A1 * | 12/2005 | Edmond | A63C 10/04 280/617 |
| 2006/0113736 | A1 | 6/2006 | Giffin et al. | |
| 2006/0237920 | A1 | 10/2006 | Steere | |
| 2006/0290105 | A1 | 12/2006 | Going | |
| 2008/0129014 | A1 * | 6/2008 | Cunningham | A63C 10/24 280/611 |
| 2008/0309052 | A1 | 12/2008 | Neiley et al. | |
| 2009/0134602 | A1 | 5/2009 | Pontano et al. | |
| 2009/0146397 | A1 | 6/2009 | Steere | |
| 2009/0174172 | A1 * | 7/2009 | Fumagalli | A63C 10/285 280/617 |
| 2010/0013192 | A1 | 1/2010 | Pascal et al. | |
| 2010/0109289 | A1 | 5/2010 | Wischhusen et al. | |
| 2010/0133786 | A1 | 6/2010 | Cunningham et al. | |
| 2010/0219613 | A1 | 9/2010 | Zaloom et al. | |
| 2011/0316256 | A1 | 12/2011 | Neiley et al. | |
| 2012/0274036 | A1 | 11/2012 | Kloster et al. | |
| 2014/0042728 | A1 | 2/2014 | Noyes et al. | |
| 2014/0239614 | A1 * | 8/2014 | Neiley | A63C 10/18 280/613 |

FOREIGN PATENT DOCUMENTS

| | | |
|---|---|---|
| TW | 305222 | 5/1997 |
| TW | 312998 | 8/1997 |
| TW | 521636 | 2/2003 |

* cited by examiner

FIXATION SEAT FOR SKI SHOE

FIELD OF THE INVENTION

The present invention is a CIP of application Ser. No. 14/312,172, filed Jun. 23, 2014, the entire contents of which are hereby incorporated by reference.

BACKGROUND OF THE INVENTION

Description of the Prior Art

A conventional ski shoe is positioned onto a ski board by a fixation seat. Conventional fixation seat disclosed in patents US 2009/0174172, TW 257991, TW 298090, TW 305222, TW 312998, and TW 521636 includes a seat, an ankle protecting board, and a fastening belt. The ankle protecting board is disposed on the upper-rear portion of the seat for an ankle portion of the ski shoe to lean against, and the fastening belt fastens the ski shoe to the seat.

However, the ankle protecting board of a conventional fixation seat is connected to the rear side of the seat and further extends to the left side and the right side of the seat as a single piece. When a user swings his ankles left and right, the seat is also distorted by the swung ankle protecting board so that the balancing is affected. On the other hand, the seat may restrict the action of swinging of the ankle protection board so that the ankle of user may be deviated from the ankle protection board. As a result, protection to the ankle is weakened.

SUMMARY OF THE INVENTION

The main object of the present invention is to provide a fixation seat for ski shoe which is more flexible for distorting.

To achieve the above and other objects, a fixation for ski shoe of the present invention includes a seat, a connecting structure, a support structure, an ankle protecting board, and a fixation structure.

The seat at least has a left side, a right side, and a rear side. The connecting structure is disposed on the seat for a ski board to connect with. The support structure includes a left support element and a right support element. The left support element extends upward and obliquely from the left side of the seat to a left portion of the rear side of the seat, and the right support element extends upward and obliquely from the right side of the seat to a right portion of the rear side of the seat. An end of the left support element located at the rear side of the seat is distant from an end of the right support element located at the rear side of the seat a predetermined distance. Two opposite sides of an end of the ankle protecting board are connected to a top of the left support element and a top of the right support element respectively so that the ankle protecting board is located above the rear side of the seat. The fixation structure is located above the seat. Two opposite ends of the fixation structure are connected to the left side and the right side of the seat respectively so that a shoe-receiving space is enclosed by the fixation structure and the seat. The fixation structure is adapted for fastening a shoe received in the shoe-receiving space with the seat. The end of the left support element and the end of the right support element extend oppositely toward each other to form a gap smaller than ⅘ of the rear side of the seat.

Because the support structure bearing the ankle protecting board is divided into two pieces, the left and the right support elements can be deformed respectively when distorting. Thus, the ankle protecting board may move following the ankle of the user to support the ankle of the user. As a result, even if the fixation seat is distorted by the user during ski, the ankle protecting board is able to support the ankle all the time.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
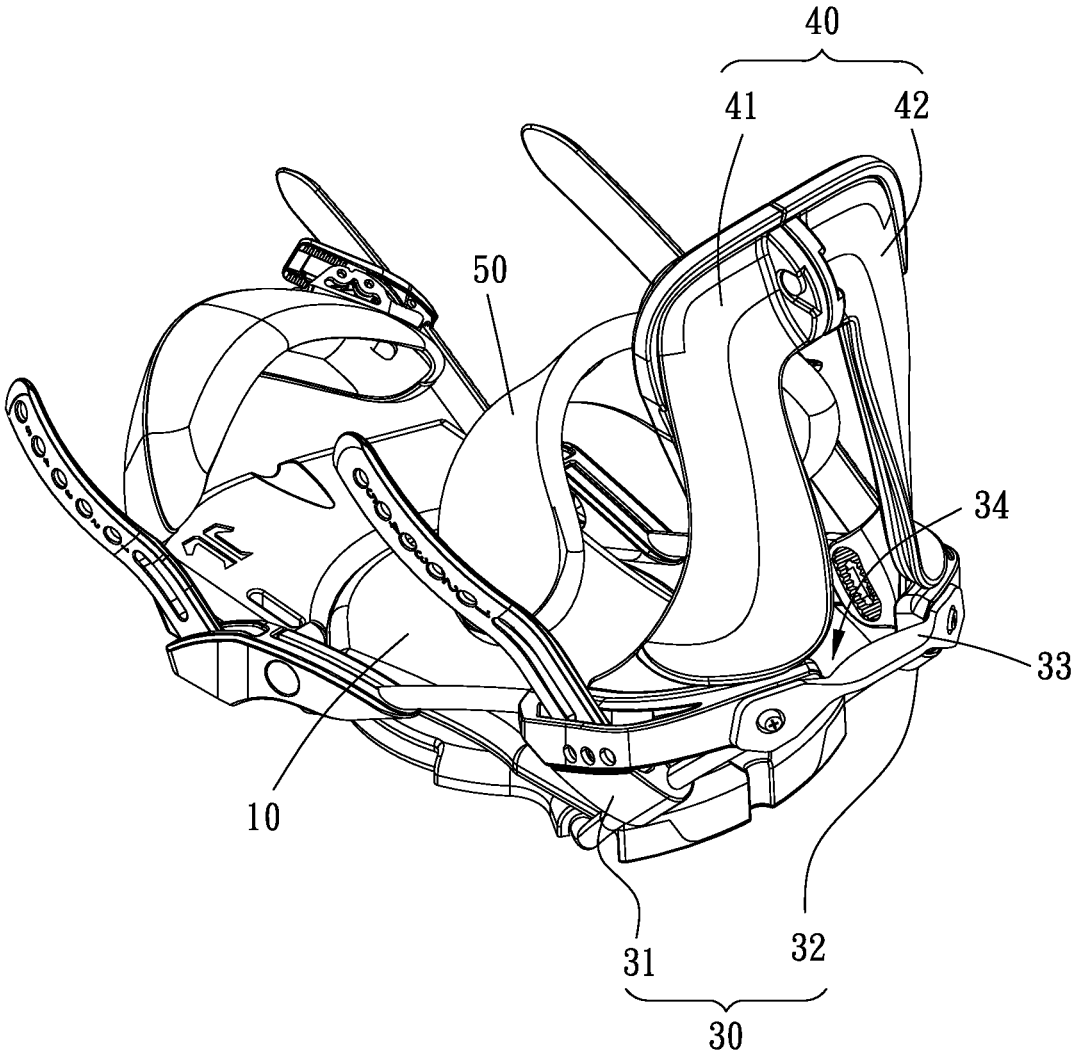
FIG. 1 is a stereogram of the present invention.
Figure 2:
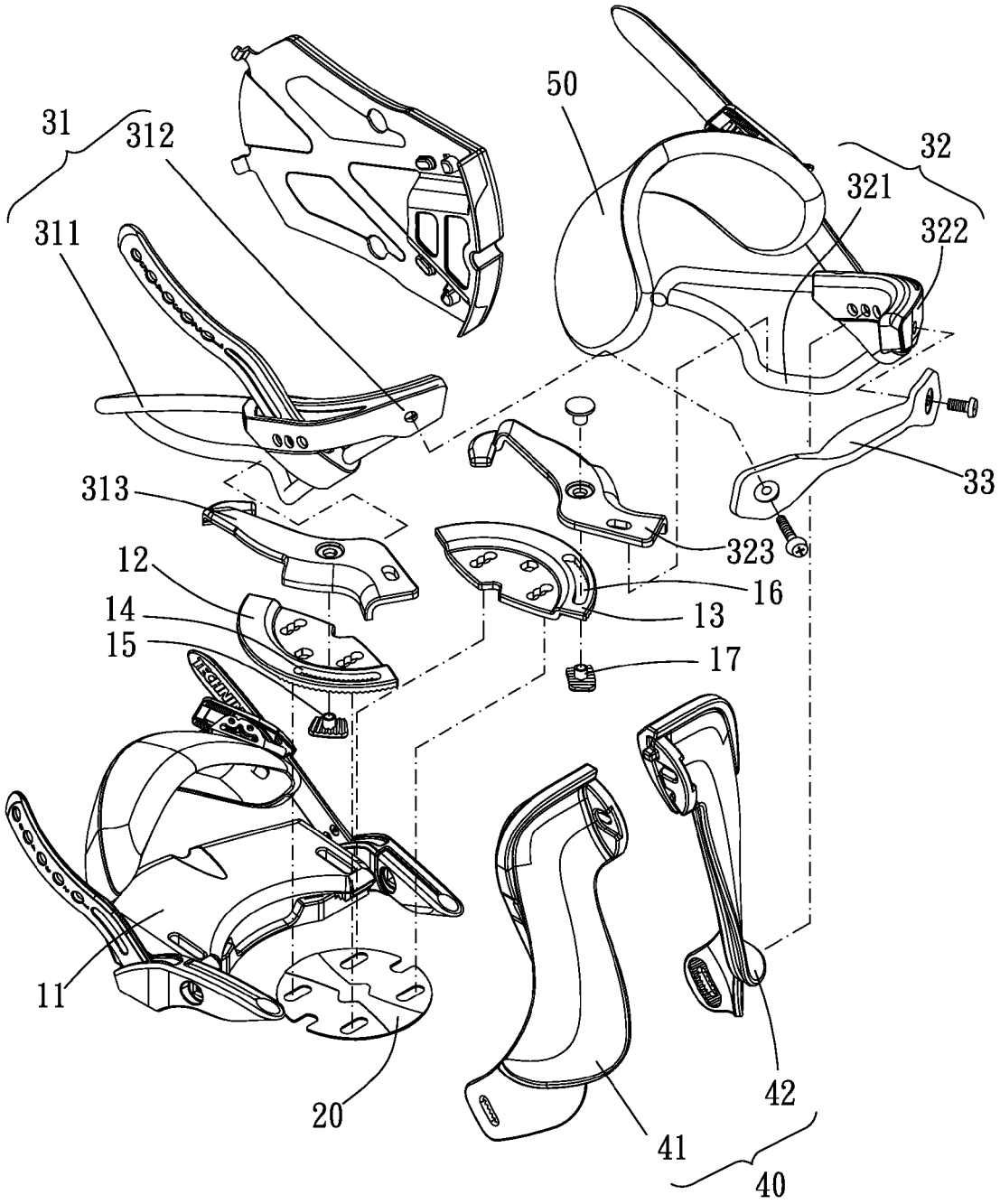
FIG. 2 is a breakdown drawing of the present invention.
Figure 3:
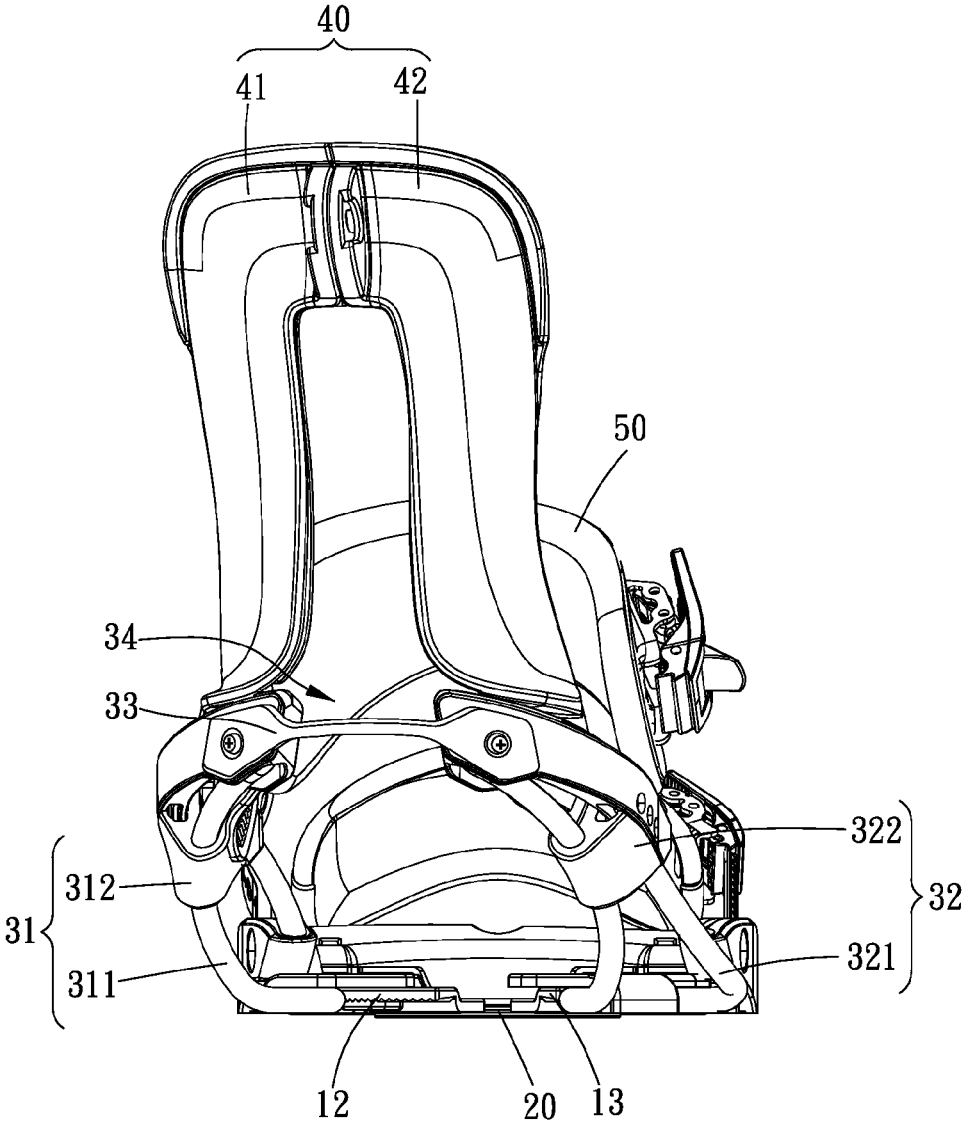
FIG. 3 is a rear view of the present invention.
Figure 3A:
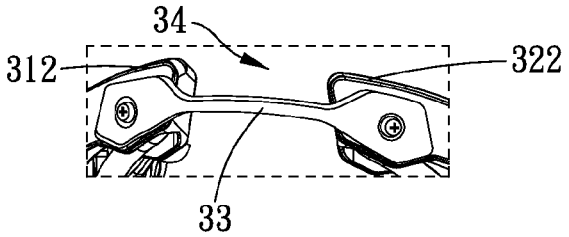
FIG. 3A is a partial view of FIG. 3.
Figure 4:
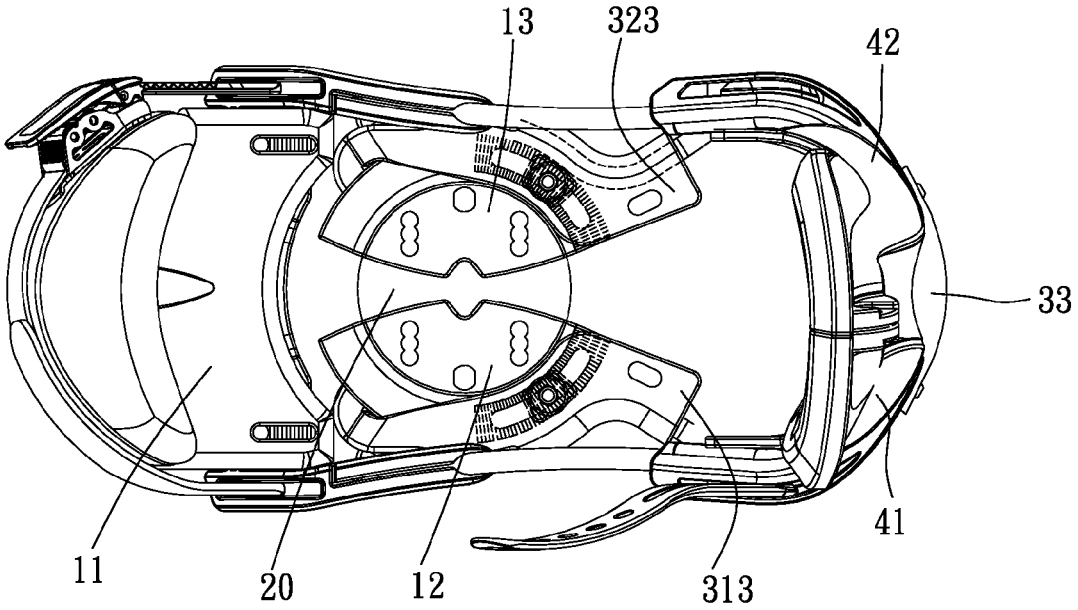
FIG. 4 is a partial top view of the present invention.
Figure 5:
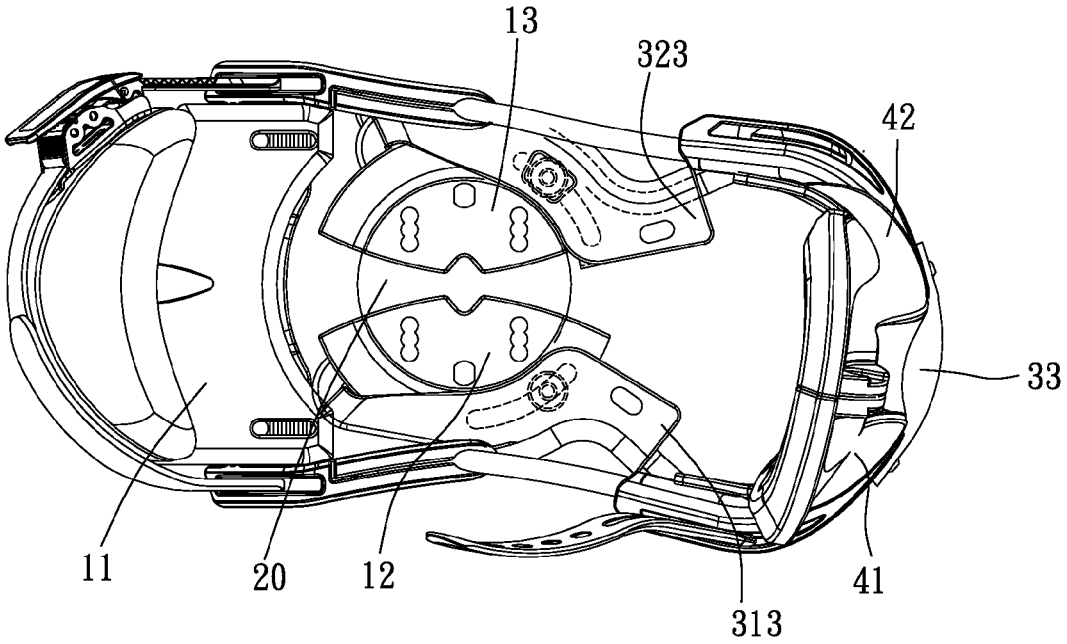
FIG. 5 is an illustration of the present invention.

Please refer to FIG. 1 to FIG. 5, the fixation seat for ski shoe of the present invention is adapted for positioning a ski shoe onto a ski board and includes a seat 10, a connecting structure 20, a support structure 30, an ankle protecting board 40, and a fixation structure 50.

The seat 10 at least has a left side, a right side, and a rear side. The connecting structure 20 is disposed on the seat 10 for connecting a ski board.

The support structure 30 includes a left support element 31 and a right support element 32. The left support element 31 extends upward and obliquely from the left side of the seat 10 to a left portion of the rear side of the seat 10. The right support element 32 extends upward and obliquely from the right side of the seat 10 to a right portion of the rear side of the seat 10. An end of the left support element 31 located at the rear side of the seat 10 is distant from an end of the right support element 32 located at the rear side of the seat 10 a predetermined distance. The end of the left support element 31 and the end of the right support element 32 extend oppositely toward each other to form a gap 34 smaller than ⅘ of the rear side of the seat 10 (preferably smaller than ½ of the rear side of the seat 10). Therefore, the left support element 31 and the right support element 32 can provide good support for ankle and good comparability for installation of the ski shoe.

In the present embodiment, the left support element 31 includes a metal frame 311 and a bearing element 312. The metal frame 311 is substantially obtuse triangle and has a base. The base is disposed on the left side of the seat 10 parallel to the left side of the seat 10. The metal frame 311 further has a support edge and an extending edge. An angle between the base and the support edge is obtuse angle, and the extending edge connects the base and the support edge together. The support edge is closer to the rear side of the seat 10 than the extending edge. The base, the support edge, and the extending edge are formed by metal bars or metal tubes. The bearing element 312 is disposed on an end of the metal frame 311 opposite to the base thereof for the ankle protecting board 40 to dispose on. Similarly, the right support element 32 includes a metal frame 321 and a bearing element 322. The metal frame 321 is substantially obtuse triangle and has a base. The base is disposed on the left side of the seat 10 parallel to the left side of the seat 10. The metal frame 321 further has a support edge and an extending edge. An angle between the base and the support edge is obtuse angle, and the extending edge connects the base and the support edge together. The support edge is closer to the rear side of the seat 10 than the extending edge. The base, the support edge, and the extending edge are formed by metal bars or metal tubes. The bearing element 322 is disposed on an end of the metal frame 321 opposite to the base thereof for the ankle protecting board 40 to dispose on. That is, a conventional support element in a single piece is displaced by the left support element 31 and the right support element 32 which are arranged spacedly in the present invention.

The left support element 31 further includes a left connecting plate 313, and the left connecting plate 313 is assembled to the metal frame 311 and selectively adjustably connected with the seat 10. The seat 10 is formed with a through arched groove 14, and the left connecting plate 313 is selectively adjustably connected with the seat 10 by disposing a pivot mechanism 15 through the through arched groove 14. The right support element 32 further includes a right connecting plate 323, and the right connecting plate 323 is assembled to the metal frame 321 and selectively adjustably connected with the seat 10. The seat 10 is formed with a through arched groove 16, and the right connecting plate 323 is selectively adjustably connected with the seat 10 by disposing a pivot mechanism 17 through the through arched groove 16.

Preferably, the seat 10 includes a front seat 11, a left seat 12, and a right seat 13 The front, left and right seats 11, 12, 13 are individual pieces and each separate from one other. The left seat 12 and the right seat 13 are disposed on two sides of the connecting structure 20 respectively, and the connecting structure 20 is resilient, such as a soft rubber plate. The connecting structure 20 is located between the ankle protecting board 40 and the front seat 11. An end of the left support element 31 is connected with the left seat 12 and a left side of the front seat 11. An end of the right support element 32 is connected with the right seat 13 and a right side of the front seat 11. The left seat 12 is distant from the right seat 13 a predetermined distance to form a gap in a predetermined width. The left seat 12 is rotatably adjustably connected with the left connecting plate 313 of the left support element 31, and the right seat 13 is rotatably adjustably connected with the right connecting plate 323 of the right support element 32. The support structure 30 further includes a linkage 33 which is pivotally connected respectively to the end of the left support element 31 and the end of the right support element 32. This allows the seat 10 to be adjusted within a large range.

Two opposite sides of an end of the ankle protecting board 40 are connected to a top of the left support element 31 and a top of the right support element 32 so that the ankle protecting board 40 is located above the rear side of the seat 10. More specifically, the ankle protecting board 40 includes a left protecting board 41 and a right protecting board 42 which is symmetrical to the left protecting board 41 and is detachably connected with the left protecting board 41. A bottom of the left protecting board 41 is detachably disposed on the left support element 31, and a bottom of the right protecting board 42 is detachably disposed on the right support element 32. Preferably, the ankle protecting board 40 is substantially reverse U-shaped. An upper-right portion of the left protecting board 41 is detachably connected with an upper-left portion of the right protecting board 42. Thus, a user can displace one of the protecting boards to meet the user's need.

The fixation structure 50 is located above the seat 10, and two opposite ends of the fixation structure 50 are connected to the left side and the right side of the seat 10 respectively so that a shoe-receiving space is enclosed by the fixation structure 50 and the seat 10. The fixation structure 50 is adapted for fastening a ski shoe received in the shoe-receiving space to the seat 10. Practically, the fixation structure 50 is belt-like. In the present embodiment, two opposite ends of the fixation structure 50 are connected to the left support element 31 and the right support element 32 so as to be connected to the left side and the right side of the seat 10 indirectly.

In use, a ski shoe is received in the shoe-receiving space and is fastened to the seat 10 by the fixation structure 50, and the seat 10 is positioned to a ski board by the connecting structure 20. Thereby, installation is completed. When a user swings his ankles left and right for turning or balancing, the ankle protecting board 40 is swung too so that the torsion is transmitted to the seat 10 via the support structure 30. However, the support structure 30 is divided into the left support element 31 and the right support element 32 which are independent from each other so as to allow deformation respectively, and the seat includes the left seat 12 and the right seat 13 to connect with the left support element 31 and the right support element 32. In addition, the connecting structure 20 is resilient so that the left portion and the right portion of the fixation seat are allowed to be swung and distorted respectively. Besides, the seat 10 may not restrict the ankle protecting board 40 too much due to the elasticity of distortion. Thus, the action of swinging of ankles can be presented perfectly. On the other hand, the ankles of the user are under better protection by supported and held well by the ankle protecting board 40 all the time.

Besides, the ankle protecting board 40 is assembled by two pieces which are detachable respectively, so one can choose desired left protecting board 41 and right protecting board 42 and assemble them to meet the needs.

What is claimed is:

1. A fixation seat for ski shoe, including:

a seat, at least having a left side, a right side, and a rear side;

a connecting structure, disposed on the seat for connecting with a ski board;

a support structure, including a left support element and a right support element, the left support element extending upward and obliquely from the left side of the seat to a left portion of the rear side of the seat, the right support element extending upward and obliquely from the right side of the seat to a right portion of the rear side of the seat, an end of the left support element located at the rear side of the seat being distant from an end of the right support element located at the rear side of the seat a predetermined distance;

an ankle protecting board, two opposite sides of an end of the ankle protecting board being connected to a top of the left support element and a top of the right support element respectively so that the ankle protecting board is located above the rear side of the seat;

a fixation structure, located above the seat, two opposite ends of the fixation structure being connected to the left side and the right side of the seat respectively so that a shoe-receiving space is enclosed by the fixation structure and the seat, the fixation structure being adapted for fastening a shoe received in the shoe-receiving space with the seat;

wherein the end of the left support element and the end of the right support element extend oppositely toward each other to form a gap smaller than ⅘ of the rear side of the seat.

2. The fixation seat for ski shoe of claim 1, wherein the left support element includes a metal frame and a bearing element, the metal frame is substantially an obtuse triangle and has a base, the base is fixed on the left side of the seat parallel to the left side of the seat, the metal frame further has a support edge and an extending edge, an angle between the support edge and the base is an obtuse angle, the extending edge connects the base and the support edge therebetween, the support edge is closer to the rear side of the seat than the extending edge, the base, the support edge, and the extending edge are metal bars, the bearing element is disposed on an end of the metal frame opposite to the base for the ankle protecting board to connect with.

3. The fixation seat for ski shoe of claim 2, wherein the left support element further includes a left connecting plate, and the left connecting plate is assembled to the metal frame and selectively adjustably connected with the seat.

4. The fixation seat for ski shoe of claim 3, wherein the seat is formed with a through arched groove, and the left connecting plate is selectively adjustably connected with the seat by disposing a pivot mechanism through the through arched groove.

5. The fixation seat for ski shoe of claim 1, wherein the right support element includes a metal frame and a bearing element, the metal frame is substantially an obtuse triangle and has a base, the base is fixed on the right side of the seat parallel to the right side of the seat, the metal frame further has a support edge and an extending edge, an angle between the support edge and the base is an obtuse angle, the extending edge connects the base and the support edge therebetween, the support edge is closer to the rear side of the seat than the extending edge, the base, the support edge, and the extending edge are metal bars, the bearing element is disposed on an end of the metal frame opposite to the base for the ankle protecting board to connect with.

6. The fixation seat for ski shoe of claim 5, wherein the right support element further includes a right connecting plate, and the right connecting plate is assembled to the metal frame and selectively adjustably connected with the seat.

7. The fixation seat for ski shoe of claim 6, wherein the seat is formed with a through arched groove, and the right connecting plate is selectively adjustably connected with the seat by disposing a pivot mechanism through the through arched groove.

8. The fixation seat for ski shoe of claim 1, wherein the ankle protecting board includes a left protecting board and a right protecting board, the left protecting board and the right protecting board has shapes corresponding to each other and are detachably connected with each other, a bottom of the left protecting board is detachably connected with the left support element, a bottom of the right protecting board is detachably connected with the right support element.

9. The fixation seat for ski shoe of claim 8, wherein the ankle protecting board is substantially reverse U-shaped, an upper right portion of the left protecting board is detachably connected with an upper left portion of the right protecting board.

10. The fixation seat for ski shoe of claim 1, wherein the seat includes a front seat, a left seat, and a right seat, the front, left and right seats are individual pieces and each separate from one other, the left seat and the right seat are disposed on two opposite sides of the connecting structure respectively, the connecting structure is resilient and is located between the ankle protecting board and the front seat, an end of the left support element is connected to the left seat and a left side of the front seat, an end of the right support element is connected to the right seat and a right side of the front seat.

11. The fixation seat for ski shoe of claim 10, wherein the left seat is rotatably adjustably connected with the left support element, and the right seat is rotatably adjustably connected with the right support element.

12. The fixation seat for ski shoe of claim 1, wherein the support structure further includes a linkage which is pivotally connected respectively to the end of the left support element and the end of the right support element.

13. The fixation seat for ski shoe of claim 1, wherein the gap is smaller than ½ of the rear side of the seat.

* * * * *